US005513602A

United States Patent [19]

Hannibal

[11] Patent Number: 5,513,602

[45] Date of Patent: May 7, 1996

[54] VALVE-ACTUATING MECHANISM

[75] Inventor: Wilhem Hannibal, Neckarsulm, Germany

[73] Assignee: Audi AG, Germany

[21] Appl. No.: 347,446

[22] PCT Filed: Jul. 15, 1993

[86] PCT No.: PCT/EP93/01866

§ 371 Date: Nov. 29, 1994

§ 102(e) Date: Nov. 29, 1994

[87] PCT Pub. No.: WO94/02713

PCT Pub. Date: Feb. 3, 1994

[30] Foreign Application Priority Data

Jul. 16, 1992 [DE] Germany ..... 42 23 475.1

[51] Int. Cl.[6] ..... F01L 1/12; F01L 1/26; F01L 1/18; F01L 13/00

[52] U.S. Cl. ..... 123/90.16; 123/90.22

[58] Field of Search ..... 123/90.15, 90.16, 123/90.17, 90.22, 90.27, 90.39, 90.4, 90.44; 251/251

[56] References Cited

U.S. PATENT DOCUMENTS

| | | | |
|---|---|---|---|
| 5,101,778 | 4/1992 | Fukuo et al. | 123/90.16 |
| 5,251,586 | 10/1993 | Koga et al. | 123/90.16 |
| 5,253,620 | 10/1993 | Dohn et al. | 123/90.16 |

FOREIGN PATENT DOCUMENTS

| | | | |
|---|---|---|---|
| 342007 | 11/1989 | European Pat. Off. . | |
| 452671 | 10/1991 | European Pat. Off. . | |
| 2753197 | 6/1978 | Germany . | |
| 175411 | 6/1992 | Japan | 123/90.39 |

*Primary Examiner*—Weilun Lo
*Attorney, Agent, or Firm*—Lalos & Keegan

[57] ABSTRACT

A valve-actuating mechanism for a plurality of identical valves of a cylinder of an internal-combustion engine has first rocker arms 5 which each actuate a valve and which are actuated by a cam for a lower speed range, and second rocker arms 7 which are arranged between adjacent first rocker arms 5 and which are actuated by specific identical cams for the upper speed range. The first and the second rocker arms 5, 7 can be coupled to one another in the upper speed range by means of a rotatable switching shaft 11 which extends through all the rocker arms and which can be actuated by an outer electromagnet 21, so that the valves are then actuated according to the contour of the cams acting on the second rocker arms 7.

4 Claims, 3 Drawing Sheets

VALVE-ACTUATING MECHANISM

FIELD OF THE INVENTION

The invention relates to a valve-actuating mechanism for an internal-combustion engine.

BACKGROUND OF THE INVENTION

In a known valve-actuating mechanism of this type (EP-A-342,007), two coupling pins butting against one another are provided in the bores of the rocker arms and can be displaced counter to a spring force, by an electromagnet arranged in one of the rocker arms, in such a way that they bridge the separating gaps between adjacent rocker arms and thus connect all the rocker arms rigidly to one another, so that the rocker arms acting on the valves are now moved by the second rocker arms according to the cam contour of the second cams. One problem in this construction is that the coupling pins have to be positioned very accurately, in order to ensure that the first two rocker arms can move freely in the uncoupled position. Furthermore, accommodating an electromagnet, by means of which the necessary short switching times of approximately 5 ms can be achieved, in the rocker arm presents considerable problems as do the dissipation of the heat generated and the current supply. Finally, in the event of repair, the valve drive has to be at least partially dismantled.

SUMMARY OF THE INVENTION

The object on which the invention is based is to provide a valve-actuating mechanism of the relevant generic type, in which the first rocker arms can be connected to the second rocker arms or be separated from these in a simpler way by means of an electromagnetically actuable coupling device.

In the proposal according to the invention, the coupling device is a rotatable switching shaft which can extend outwards, so that the electromagnet can be arranged at a suitable point next to the switching shaft in the cylinder head, where there is, of course, more space than in a rocker arm and the dissipation of the heat generated presents no problems. A further advantage is that, if a defect occurs, the electromagnet can be exchanged easily, whereas, in such a case, an at least partial dismounting of the valve drive would be necessary in the known mechanism.

BRIEF DESCRIPTION OF THE DRAWINGS

An exemplary embodiment of the invention is described below with reference to the drawings. In these.

DETAILED DESCRIPTION

Figures 1, 2:
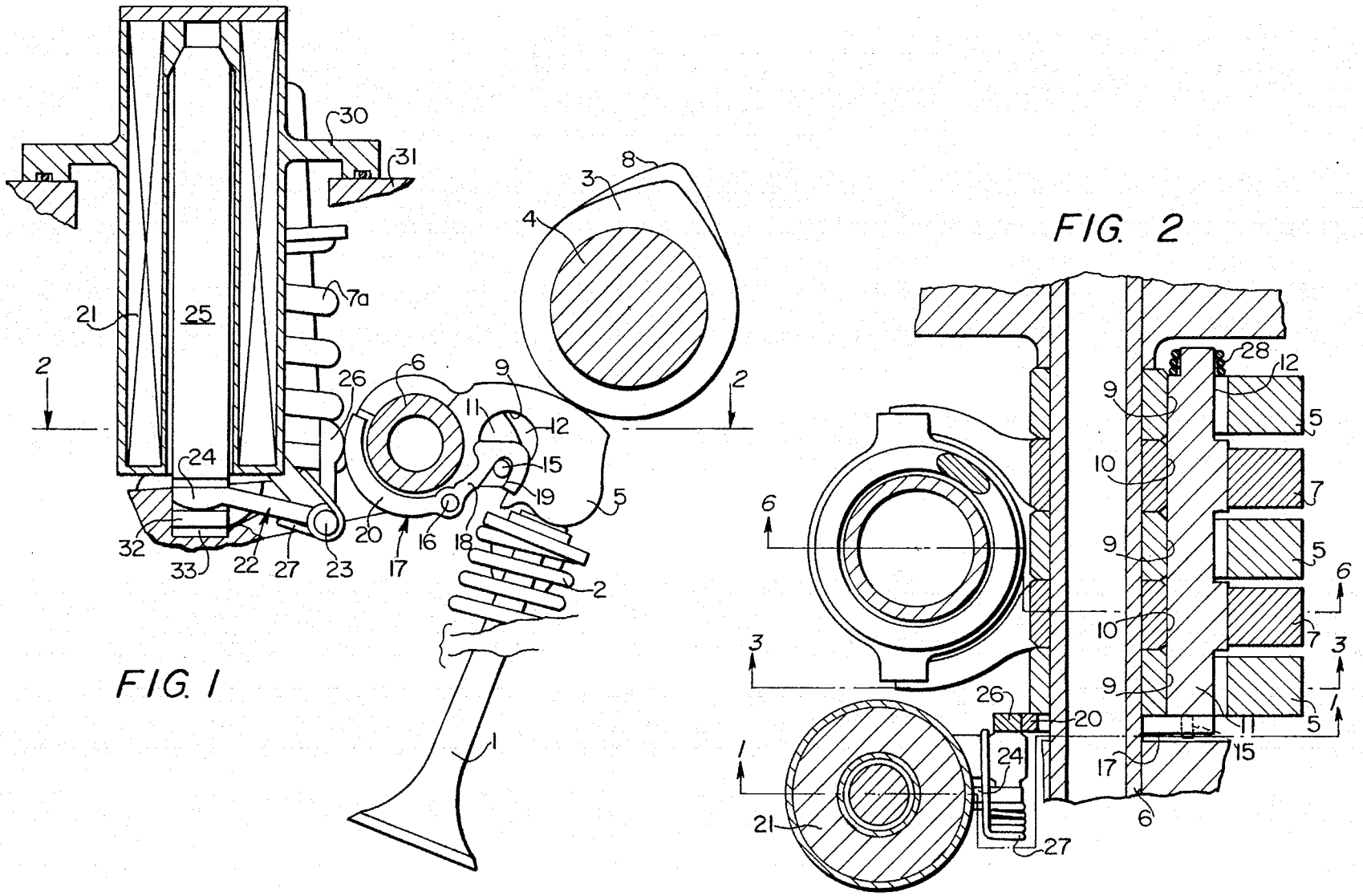
FIG. 1 shows a valve drive with a valve-actuating mechanism according to the invention for three inlet valves in a vertical section along the line 1—1 in FIG. 2.
FIG. 2 shows a section along the line 2—2 in FIG. 4.
Figure 6:
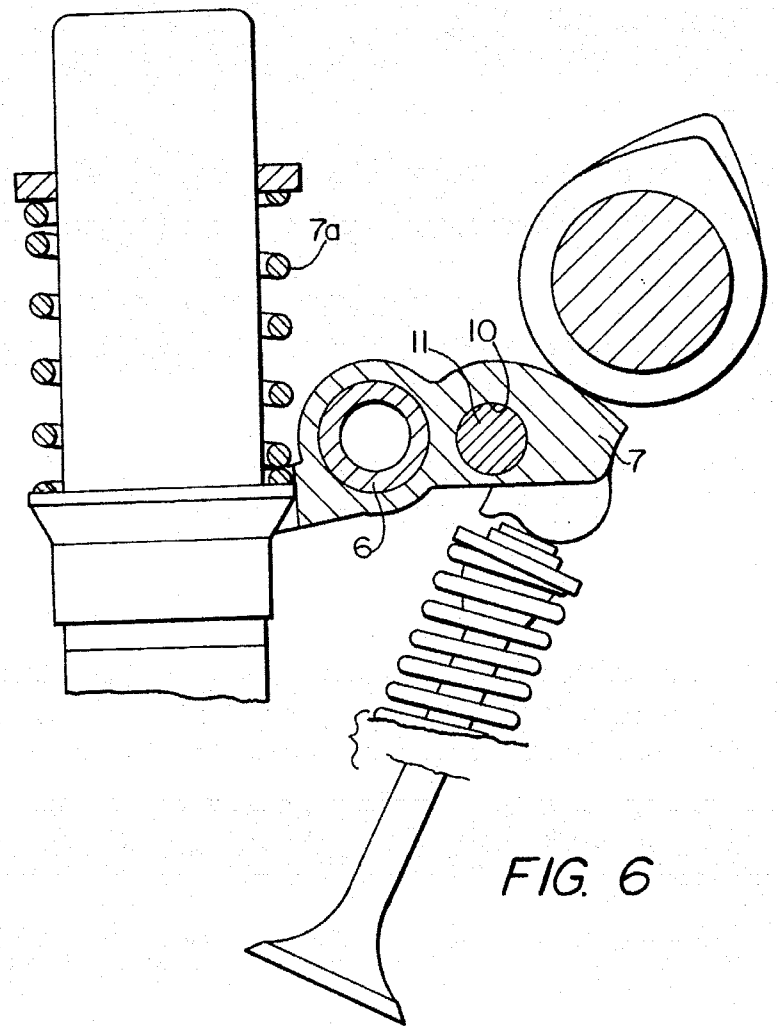
FIG. 6 shows a section along the line 6—6 in FIG. 2.
Figure 5:
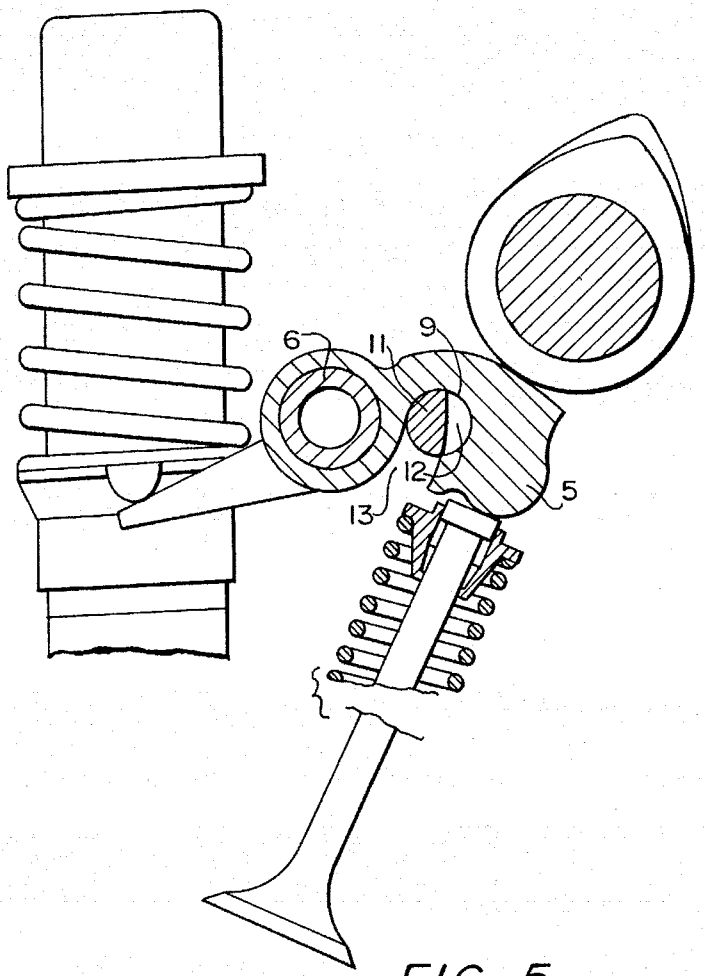
FIG. 5 shows a section corresponding to that of FIG. 3, the switching shaft being shown in the position according to FIG. 4.

The drawings show a valve drive for three inlet valves 1, of which, however, only one is shown in FIG. 1. Each valve 1 is loaded in the closing direction by a spring 2. The valves are actuated by specific cams 3 of a camshaft 4 via rocker arms 5 which are mounted pivotably on a common axle 6 of fixed location. The cams 3 can have diffrent cam profiles for the individual inlet valves, in order to obtain a different valve stroke, a different opening duration and/or different control times and to afford optimum preconditions in the lower and medium speed range of the internal-combustion engine. Arranged on the axle 6 between adjacent first rocker arms 5 are second rocker arms 7 actuated by second cams 8 having an identical cam profile which is designed for the conditions in the upper speed range of the internal-combustion engine, that is to say, for example, brings about a larger valve stroke and a longer opening duration. The second rocker arms 7 have extensions which extend rearwards and on which is supported a spring 7*a* which endeavours to keep the second rocker arms bearing against their cams 8. The second rocker arms 7 can be coupled to the first rocker arms 5 in the upper speed range, so that, in this speed range, the valves 1 are actuated according to the contour of the second cams 8. For this purpose, the first and the second rocker arms 5 and 7 have bores 9 and 10 which extend parallel to their pivot axis and which are aligned with one another when the valves are closed. Through all the bores 9, 10 extends a rotatable switching shaft 11 which is mounted in the bores 10 of the second rocker arms 7 and which has cutouts 12 in the region of the bores 9 in the first rocker arms 5. As is evident from FIGS. 3 and 5, the bores 9 in the first rocker arms 5 are opened downwards over a part region 13. When the switching shaft 11 is in the position shown in FIG. 5, the second rocker arms 7 can pivot downwards, without taking along the first rocker arms 5, since, as a result of the cutouts 12 and the open regions 13 of the bores 9, the switching shaft 11 can slide out of these bores. The valves are thus actuated according to the contours of the cams 3.

Figure 3:
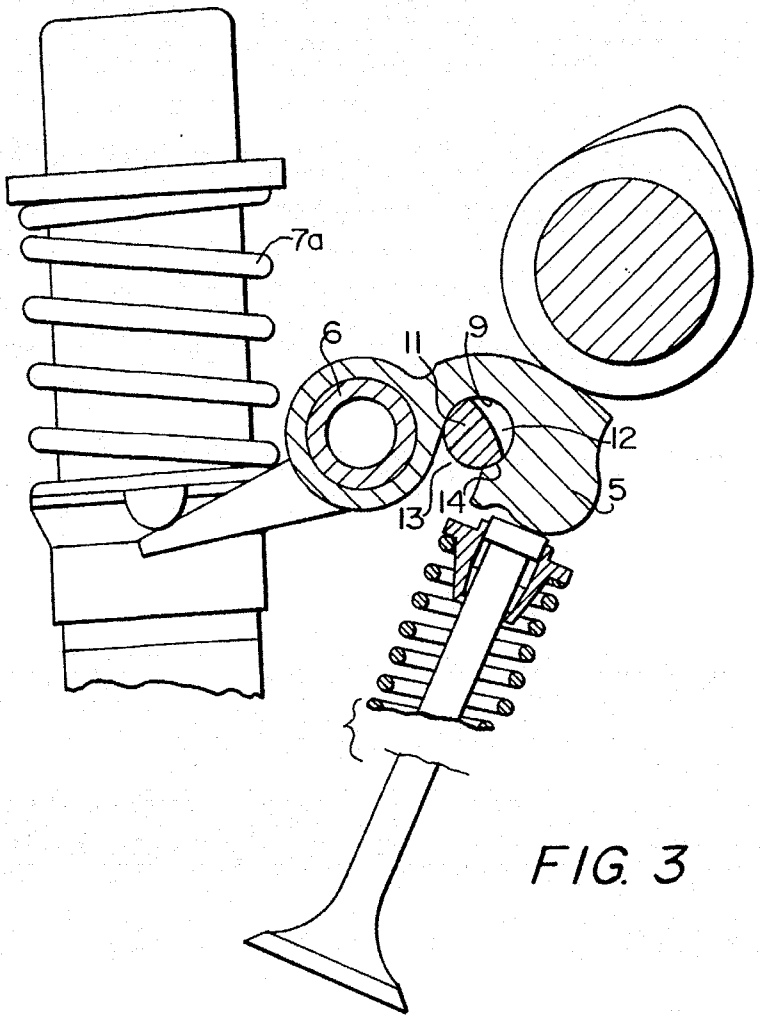
FIG. 3 shows a section along the line 3—3 in FIG. 2, the switching shaft being shown in the position according to FIG. 1.

When the switching shaft 11 is rotated into the position shown in FIGS. 1 and 3, a positive coupling of the first rocker arms 5 with the second rocker arms 7 takes place, since the switching shaft 11 cannot slide out of the bores 9, but is supported on the walls of the bores 9 via the circumferential region 14.

To rotate the switching shaft 11, the latter is provided with an eccentric extension 15 at its end on the left in FIG. 2. Mounted on a pivot pin 16 on the outer face of the first rocker arm 5 on the left in FIG. 2 is a two-armed switching lever 17, the first arm 18 of which has an arcuate slot 19, into which the extension 15 engages, and the second arm 20 of which extends in the form of an arc of a circle and is concentric to the pivot axis of the rocker arms in the position shown in FIG. 1. The switching lever 17 is pivoted by means of an electromagnet 21 into the position shown in FIG. 1, in which the rocker arms 5 and 7 are coupled to one another, as previously described and as shown in FIG. 3. For this purpose, there is pivotably mounted at 23 on the housing of the electromagnet 21 an angled lever 22, one arm 24 of which cooperates with the armature 25 of the electromagnet and the other arm 26 of which bears against a second lever arm 20 of the switching lever 17 when the electromagnet 21 is energised. After the deenergisation of the electromagnet 21, a torsion spring 27 returns the armature 25 and the angle lever 22 into the position shown in FIG. 4. In this position, the switching shaft 11 is rotated by a torsion spring 28 (FIG. 2), seated on the right-hand end of the switching shaft 11 and connected at one end to the switching shaft and at the other end to the adjacent rocker arm 5, back into the position shown in FIG. 5, in which the first rocker arms 5 are uncoupled from the second rocker arms 7, that is to say the valves 1 are actuated according to the contour of the first cams 3.

Figure 4:
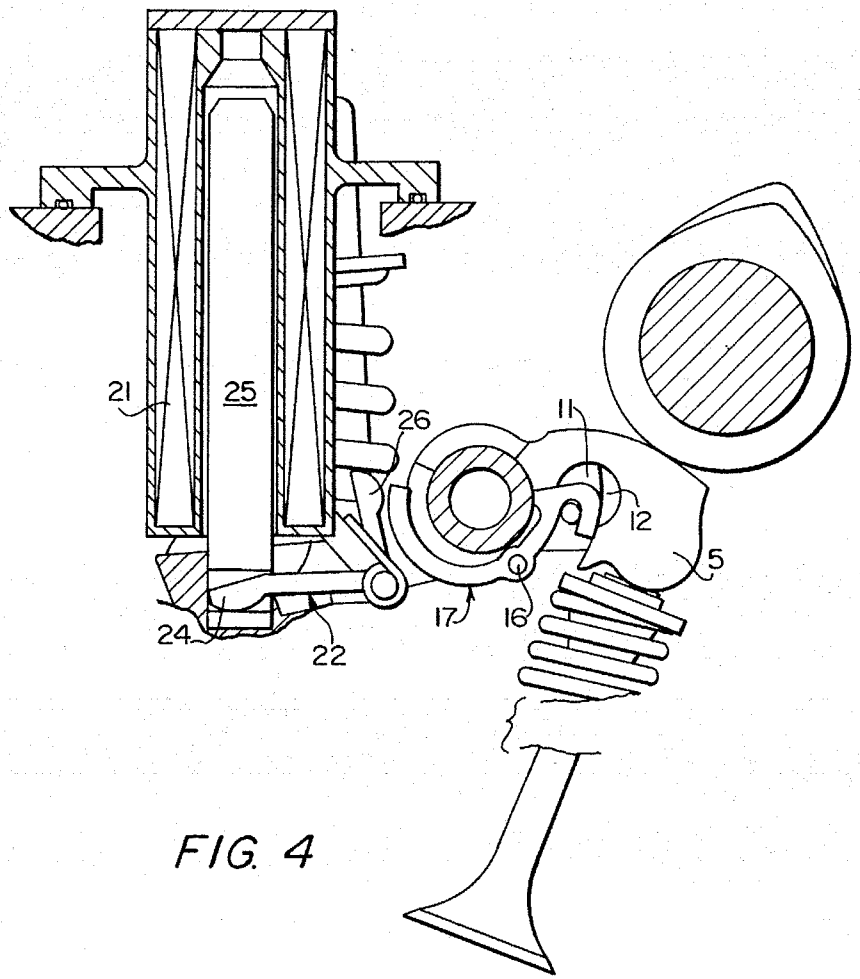
FIG. 4 shows a section corresponding to that of FIG. 1, the coupling device being shown in a second position.

As is evident from FIG. 4, when the electromagnet 21 is not energised the arm 26 of the angle lever 27 is out of contact with the second arm 20 of the switching lever 17, so that no friction is generated.

The housing of the electromagnet 21 has a flange 30 which is screwed to a corresponding face 31 in the cylinder head, and the lower end 32 of the armature 25 is seated in a corresponding bore 33 in the cylinder head. The electromagnet 21 can thereby be mounted and dismounted, without the need to take action in the valve-actuating mechanism.

The exemplary embodiment shows a valve-actuating mechanism for three inlet valves. This mechanism can, of course, also be used for a larger or smaller number of inlet valves. If a plurality of outlet valves is provided for each cylinder, these can, if necessary, likewise be actuated by means of a mechanism of this type.

I claim:

1. A valve actuating mechanism for an internal combustion engine including:

at least two valves per cylinder;

a camshaft (4) including first cams (3), and second cams (8) having a different cam profile than said first cams;

first rocker arms (5), each of which engages a first cam and one of said valves;

second rocker arms (7) located between adjacent first rocker arms, each of which engages a second cam;

said first and second rocker arms having a common pivot axis and including bores (9, 10) that extend parallel to said common pivot axis, said bores being aligned with each other when said valves are closed;

an electromagnetically actuable coupling device (11) for coupling said first rocker arms to said second rocker arms in a first speed range and for uncoupling said first rocker arms from said second rocker arms in a second speed range;

said coupling device including a rotatable switching shaft (11) that extends through all of said bores (9, 10) and is mounted in said bores (10) of said second rocker arms;

said shaft including cutouts (12) in the region of said bores (9) of said first rocker arms, said bores (9) of said first rocker arms including a downwardly projecting opening (13);

an electromagnet (21) and a spring (28) for rotating said switching shaft (11) between a first position in which said shaft passes from said bores (9) in said first rocker arms through said downwardly projecting openings (13), and a second position in which said switching shaft couples said first rocker arms to said second rocker arms.

2. A valve actuating mechanism as in claim 1 wherein:

said electromagnet (21) includes a movable part (25);

said switching shaft (11) includes an eccentric extension (15) on a first shaft end;

one of said first rocker arms (5) adjacent said first shaft end includes a rotatably mounted two-armed switching lever (17) including a first arm (18) for engagement with said extension (15) and a second arm (20) for cooperative engagement with said movable part (25) of said electromagnet.

3. A valve actuating mechanism as in claim 2 wherein:

said second arm (20) of said switching lever has a shape of a segment of an arc of a circle;

said electromagnet including a housing and an angled lever (22) rotatably mounted on said housing between said switching lever and said movable part of the electromagnet, and wherein when said electromagnet is deenergised said angled lever comes out of contact with said second arm (20) of said switching lever.

4. A valve actuating mechanism as in claim 2 further including:

a torsion spring (28) having one end supported on said switching shaft (11) and having an opposite end supported on one of said first rocker arms.

* * * * *